US005655651A

United States Patent [19]

Maier

[11] Patent Number: 5,655,651

[45] Date of Patent: Aug. 12, 1997

[54] PALETTE AND EASEL ASSEMBLY

[76] Inventor: Michael Lynn Maier, 1392 Southfork Rd., Cody, Wyo. 82414

[21] Appl. No.: 455,342

[22] Filed: May 31, 1995

[51] Int. Cl.[6] ..... B05C 17/00

[52] U.S. Cl. ..... 206/1.7; 312/231; 248/448; 248/452

[58] Field of Search ..... 206/1.7, 45.2, 206/45.24, 371; 248/447.1, 447.2, 448, 449, 452; 312/231

[56] References Cited

U.S. PATENT DOCUMENTS

| | | | |
|---|---|---|---|
| 2,067,309 | 1/1937 | Wogaman | 312/231 |
| 2,586,524 | 2/1952 | Dussardier | 312/231 |
| 3,514,173 | 5/1970 | Ford | 312/231 |
| 3,669,227 | 6/1972 | Alford | 312/231 |
| 4,093,326 | 6/1978 | Ford | 312/231 |
| 5,348,144 | 9/1994 | Maier | 206/1.7 |

*Primary Examiner*—David T. Fidei
*Attorney, Agent, or Firm*—Risto A. Rinne, Jr.

[57] ABSTRACT

An easel is pivotally attached to a palette about an axis by at least one hinge. According to a first embodiment an extensible member is detachably attached to the palette and includes a first retracted position and a second extended position wherein the extensible member substantially extends to the rear of the palette in the second position. A brace having a slot is detachably attached at one end thereof to an end of the extensible member disposed furthest to the rear of the palette and is detachably attached at a remaining end thereof to said easel. A pair of thumbscrews pass through the slot at opposite ends thereof and are used to tighten the brace to the extensible member and to the easel, thereby securing the easel in a desired position with respect to the palette. According to a second embodiment, a pivot member is pivotally attached to the palette and includes a first position wherein the pivot member is disposed under said palette and a second position wherein the pivot member substantially extends to the rear of the palette. A bracket having a U-shaped slot on one end thereof secures the pivot member in position in the second position and a modified brace is detachably attached to the pivot member and to the easel.

19 Claims, 4 Drawing Sheets

PALETTE AND EASEL ASSEMBLY

BACKGROUND OF THE INVENTION

1. Field of the Invention

The present invention, in general, relates to artist palettes and easels and, more particularly, to a combination of such devices.

Artist palettes and easels are well known including combinations thereof. The utility of the combination has well been established toward creating a work of art, such as an artist's preliminary sketch or a final painting.

However for combinations of palettes and easels, a particular problem has existed with all such known prior types of devices in that they tend to accumulate excess paint as the artist makes his/her brush strokes. That problem is inherent in both the means to orient the easel back at an angle with respect to the palette and also with the means to hold the artist panel on the easel.

To hold the easel at the proper angle with respect to the palette, an arm (side brace) typically extends from one side of the palette to one side of the easel. See prior U.S. Pat. No. 5,348,144 to Maier which issued Sep. 20, 1994 and is incorporated herein by way of reference for an example of such a palette and easel combination (reference numeral 32) that is further adapted to be inserted into an artist sketch box.

In particular, the side brace (Reference numeral 49) thereof is disposed intermediate the easel and palette where the brush of an artist might make contact with the brace during use.

In particular, when the artist makes a brush stroke which extends off of the panel and makes contact with the brace, the brace either squeezes paint off of the brush which tends to run down the brace and onto the panel and palette, thereby compromising the art produced or the brace contacts the brush handle thereby limiting the artist to stay well within the borders of the panel.

If, by way of a solution, the hinges are designed to hold the easel in position by means of friction within the hinges, then a great strain is induced between the palette and the easel when they are either forced into an open position for use or are closed. This tends to shorten the life thereof, or at best, provides an insufficient method for maintaining orientation between the panel and easel when pressure (i.e. from brush strokes) is applied.

Similarly, a common method of securing the panel to the easel, has included the use of a pair of opposite grooved areas and of placing the panel therein. The grooves also tend to squeeze paint off of the brush if contact is made during painting. As an example of a pair of grooves to hold a panel in position, once again refer to the above mentioned U.S. Pat. No. 5,348,144 to Maier which issued Sep. 20, 1994.

When the artist stays well within the borders of the panel to avoid contact with a brace or with panel retaining grooves, a smaller work of art results. As even a preliminary sketch can become valuable, the artist must later retouch the edges of such a panel to make it more marketable.

Accordingly the overall problem to be solved is in providing a palette and easel assembly that allows uninhibited brush strokes by the artist.

The problems as described hereinabove apply for all types of artist media including oil, acrylic, and water color paints. Depending upon the media, the size and particular shape of the easel and palette are varied to suit. However the hereinabove mentioned problems occur for all types of media.

Certain palette and easel combinations are adapted to fit inside of an artist sketch box as is the case with above cited prior art U.S. Pat. No. 5,348,144 to Maier. Others are free standing units. Still others are adapted to fit on tripods and may of themselves be either carried separately or inserted into an artist sketch box. Regardless of the particular type of combination palette and sketch box, artists have had to be careful not to squeeze (wipe or squeegee) paint off of their brushes by making contact with either the brace or the grooves.

Accordingly there exists today a need for a combination artist palette and easel assembly that provides an adequate method of orienting the easel with respect to the palette or of holding the panel thereto that lessens the amount of paint that is squeezed off of the brush as it passes off of the panel during brush strokes.

2. Description of Prior Art

Easels and palettes are, in general, known. For example, the following patents describe various types of these devices:

U.S. Pat. No. 1,175,070 to Maxwell, Mar. 14, 1916;
U.S. Pat. No. 1,221,510 to Christensen, Apr. 3, 1917;
U.S. Pat. No. 2,515,703 to Dumas, Jul. 18, 1950;
U.S. Pat. No. 2,648,933 to Brooks et al, Aug. 18, 1953;
U.S. Pat. No. 2,867,928 to Angell, Jan. 13, 1959;
U.S. Pat. No. 2,940,200 to Endlich, Jun. 14, 1960;
U.S. Pat. No. 3,672,742 to Barg, Jun. 27, 1972;
U.S. Pat. No. 4,061,224 to Fuhri, Dec. 6, 1977;
U.S. Pat. No. 4,372,630 to Fuhri, Feb. 8, 1983;
U.S. Pat. No. 5,163,547 to Hsieh, Nov. 17, 1992; and
U.S. Pat. No. 5,348,144 to Maier, Sep. 20, 1994.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide an easel and palette assembly that secures the palette in pivotal orientation with respect to the easel.

It is also an object of the invention to provide an easel and palette assembly that secures the palette in pivotal orientation with respect to the easel while preventing excess or unwanted paint from being inadvertently squeezed off of an artist brush during use.

Another object of the invention is to provide an easel and palette assembly that is easy to use.

Still another object of the invention is to provide an easel and palette assembly that holds an artist panel to the easel in a way that helps prevent excess or unwanted paint from being squeezed off of an artist brush during use.

Still yet another object of the invention is to provide an easel and palette assembly that can accommodate various sizes of artist panels.

Yet another object of the invention is to provide an easel and palette assembly that is easy to manufacture.

Still yet another important object of the invention is to provide an easel and palette assembly that holds an artist panel to the easel in a way that allows for an artist to make uninhibited brush strokes upon the panel.

Briefly, an easel and palette assembly that is constructed in accordance with the principles of the present invention has an easel that is pivotally attached to a palette by at least one hinge. A method of securing the easel in a desired orientation with respect to the palette is provided that extends to the rear of the easel where it is not in the way during use. According to one preferred embodiment a supporting extensible member that is attached to the palette extends to the rear of the palette beyond the easel and is attached to a brace member which, in turn, extends back to the easel where it is attached. According to a second preferred embodiment, a supporting pivotal member is pivotally attached to the palette and pivots toward the rear of the palette beyond the easel and is attached to a brace member which in turn extends back to the easel where it is attached. A top extensible hook secures the panel to the easel according to one embodiment and a pair of side extensible hooks secure the panel to the easel according to a second embodiment.

DETAILED DESCRIPTION OF THE INVENTION

Figure 1:
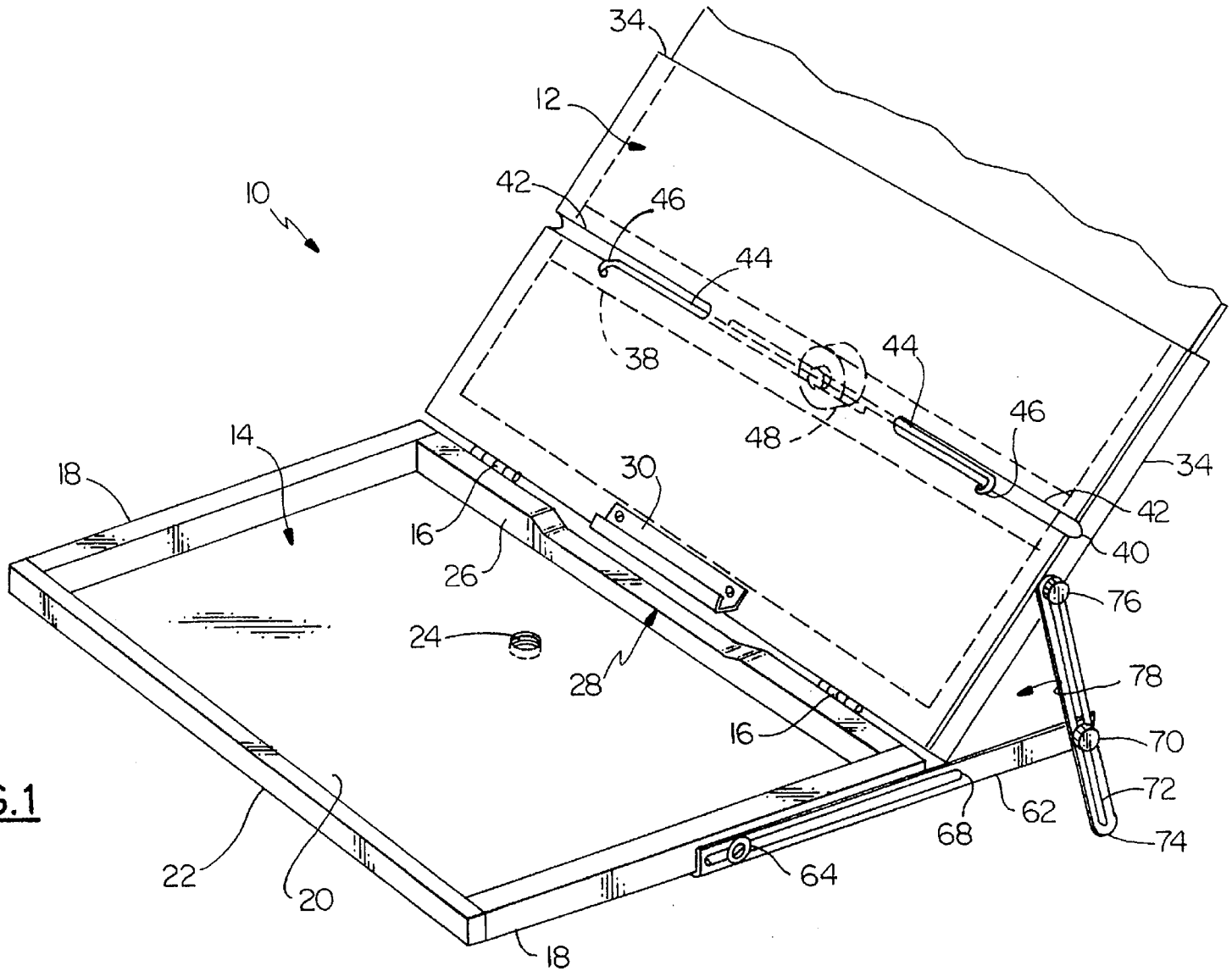
FIG. 1 is a view in perspective of an easel and palette assembly in a first open position wherein a supporting extensible member that is attached to the palette extends to the rear of the easel.
Figure 2:
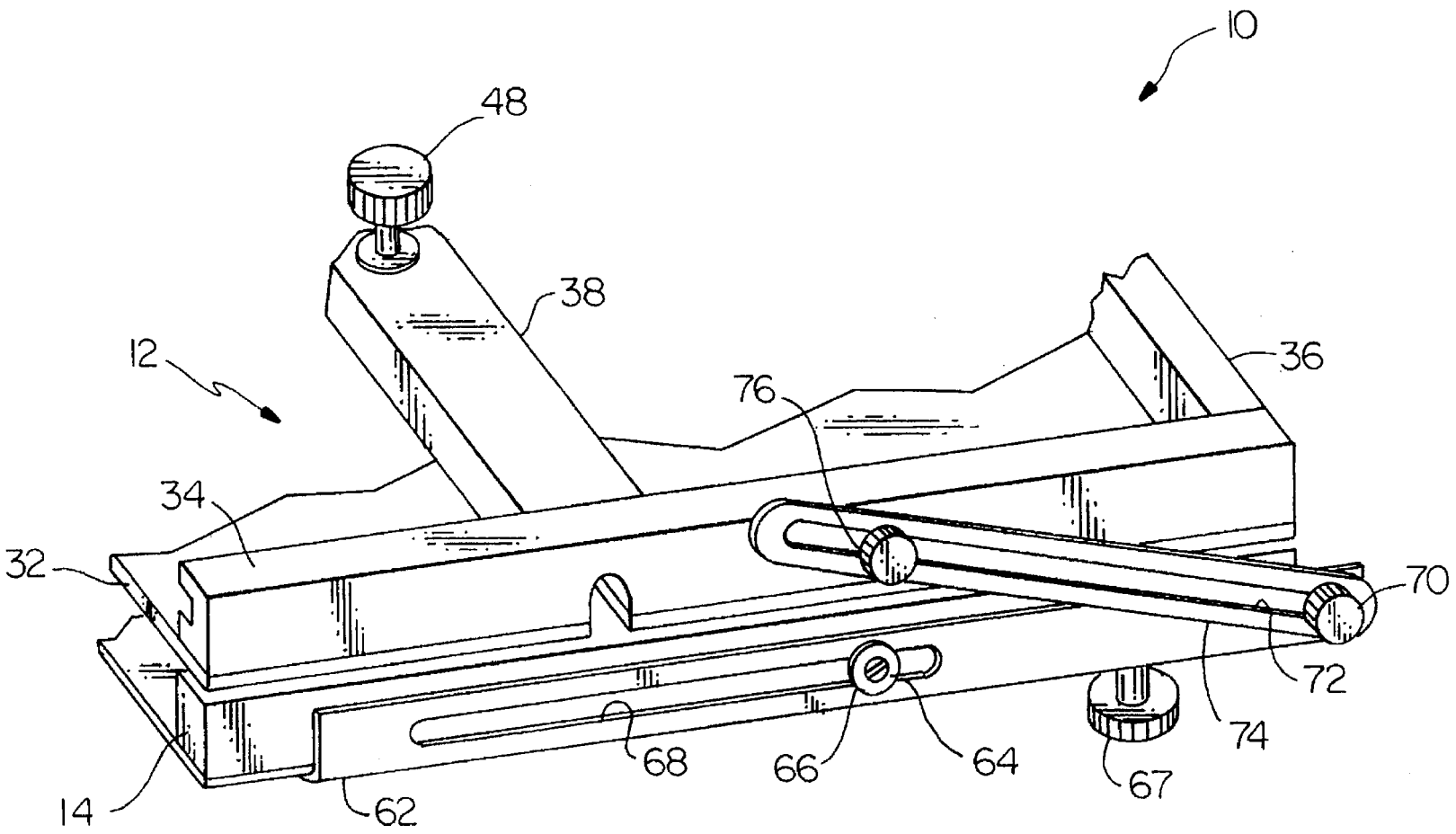
FIG. 2 is a view in perspective of an easel and palette assembly in a second closed position wherein a supporting extensible member that is attached to the palette is retracted.
Figure 4:
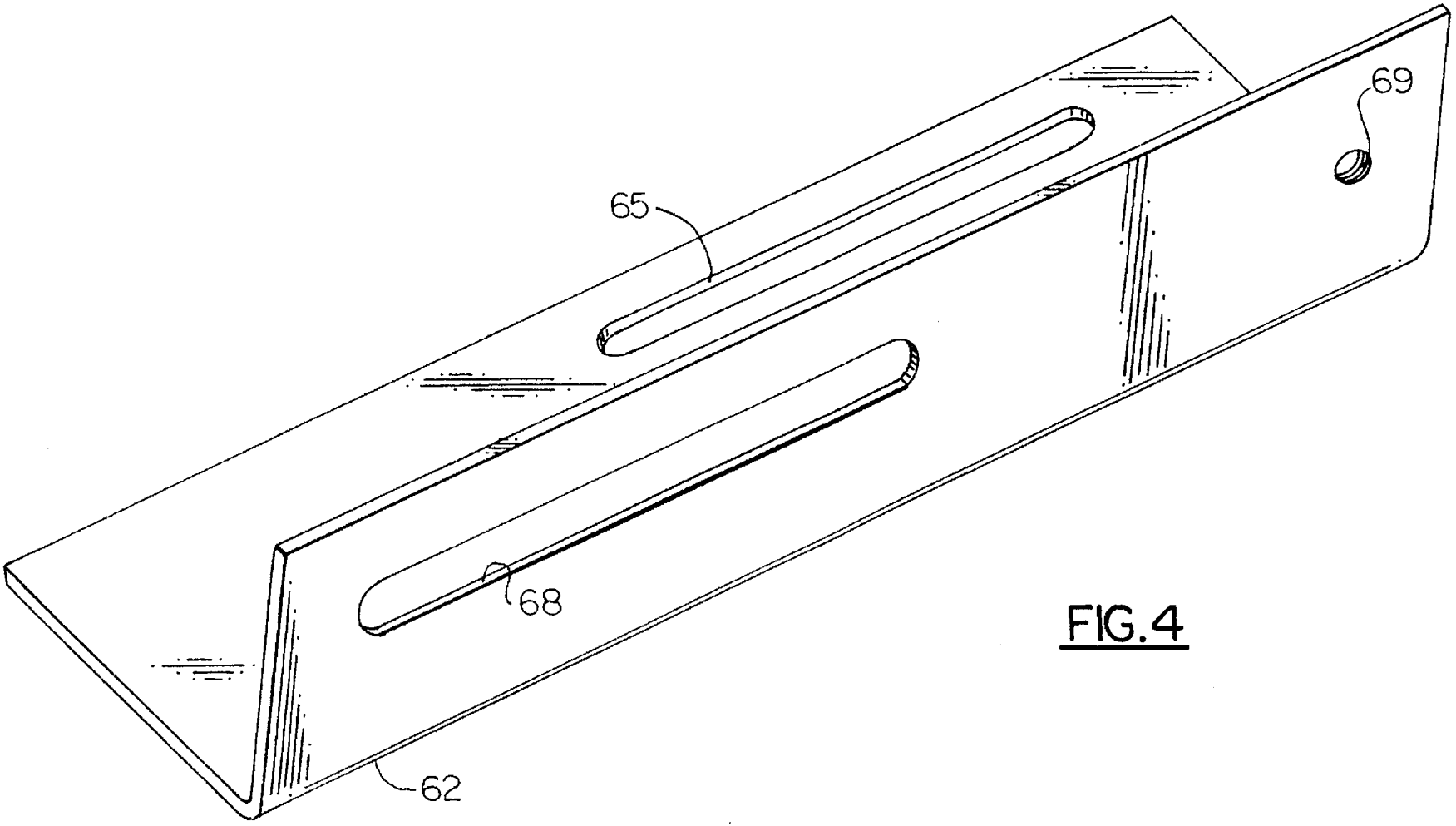
FIG. 4 is a view in perspective of supporting extensible member.

Referring primarily to FIG. 1, FIG. 2 and FIG. 4 is shown, an easel and palette assembly, identified in general by the numeral 10. An easel 12 is pivotally attached to a palette 14 by a pair of hinges 16. FIG. 1 shows the assembly 10 in a first open position and FIG. 2 shows the assembly 10 in a second closed position.

It is noted that the term palette 14 as used herein applies generally both to devices where the palette 14 is used to place paints thereon and where the palette 14 provides a structure for supporting the easel 12 (or where the palette 14 provides a small table to place items thereon).

When the palette 14 is used to place paints thereon, paint may be either directly placed on the palette 14 or, if preferred, on a surface that is placed intermediate the palette 14 and the paint.

The term palette 14 also includes any substantially flat structural surface that is pivotally related to the easel 12. It does not matter whether is is used to mix or deposit paints thereon.

The reason for this is because the palette 14, as described hereinbelow, is suitable for use with a tripod, and the artist may simply use the palette 14 as an interface to secure both the palette 14 and the easel 12 in position on a tripod. He may in fact use a separate palette for mixing his paints while using the palette 14 of the assembly 10 as a small table to place sundry items thereon.

Depending upon the materials used for the construction of either the easel 12 or the palette 14 they are either themselves assemblies or are components of the assembly 10. For example is wood is used to form all of the component parts of the easel 12 or of the palette 14, they would be regarded as assemblies. It is possible to manufacture the easel 12 or the palette 14 as a unit by well known processes such as by plastics injection molding or the like. For the purposes of clarity each will be described as if it were assembled of smaller pieces.

The palette includes a pair of side members 18 that are each attached to a base plate 20. A front member 22 is attached to the base plate 20 and to each of the side members 18.

A tripod mount 24 is attached to the bottom of the base plate 20 and is shown in dashed lines. The tripod mount 24 typically includes screw threads that adapted to fit most tripods (not shown). The most common size for such screw threads is ¼ inch by 20 threads per inch.

A rear member 26 is similarly attached to base plate 20 and to each of the side members 18. The rear member includes a recessed area, identified in general by the reference numeral 28. The recessed area 28 is provided to accommodate a panel support shelf 30 that is attached near to the bottom of the easel 12 when the easel 12 is pivoted into the closed position, as is shown in FIG. 2.

The easel 12 includes a planar panel 32. Attached to the back of the planar panel 32 are a pair of planar panel side members 34 and a planar panel base member 36. The planar panel side members 34 and the planar panel base member 36 provide strength and rigidity to the planar panel 32 of the easel 12. The planar panel base member 36 also provides strength to hold the panel support shelf 30 thereto.

Similarly, the pair of side members 18, the front member 22, and the rear member 26 also provide strength and rigidity to the base plate 20 of the palette 14.

The easel 12 also includes a central cross member 38 which traverses across the easel 12 in substantially parallel alignment with the axis as defined by the hinges 16. The cross member 38 includes a channel 40 which extends the length thereof and is disposed adjacent to the planar panel 32. The planar panel 32 also includes a pair of U-shaped channels 42 that are formed therein through the planar panel 32 and which extend from each side of the planar panel toward the center thereof. Each of the U-shaped channels 42 are separated from each other at the center of the planar panel 32 by a predetermined distance.

A pair of extensible hooks 44 are disposed in each of the U-shaped channels 42 so that a hooked end 46 of each extends above the planar panel 32 surface and the remainder of each of the extensible hooks 44 extends in the channel 40 through the center of the planar panel 32. A center thumbscrew 48 (FIG. 2) is attached to the cross member 38 and, when tightened, extends through the cross member 38 and into the channel 40 where it applies a force to both of the extensible hooks 44 thus securing them in position.

Accordingly by first loosening the center thumbscrew 48 it is possible to either further extend the extensible hooks 44 further apart or retract them closer together by grasping and moving the hooked end 46 of each of the extensible hooks 44.

In use an artist panel (not shown) is placed on the panel support shelf 30. The extensible hooks 44 are then extended further apart to clear the sides of the artist panel. The extensible hooks 44 are then retracted closer together so that the hooked end 46 of each wraps around an end of the artist panel. The center thumbscrew 48 is then tightened to secure the extensible hooks 44 and the artist panel in position during use. To remove the artist panel, the center thumbscrew 48 is loosened, the extensible hooks 44 are pulled apart, and the artist panel is then removed off of the panel support shelf 30.

Figure 3:
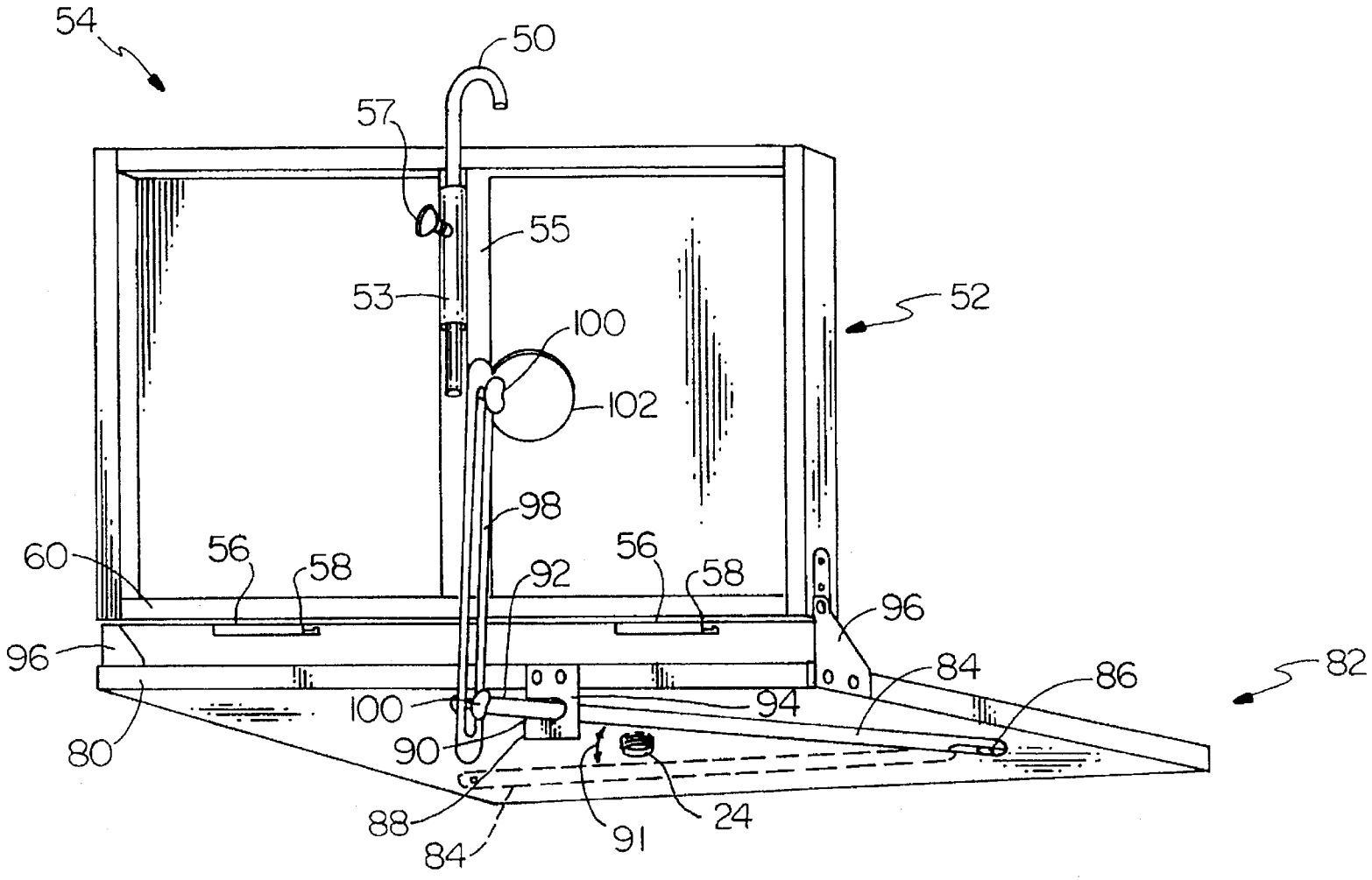
FIG. 3 is a view in perspective of the bottom and rear of a modified easel and palette assembly wherein a supporting pivotal member has been pivoted to the rear of the easel.

Referring momentarily to FIG. 3, a vertical extensible hook 50 is disposed in the center rear of the modified easel, identified in general by the reference numeral 52. The perspective view of FIG. 3, reveals a perspective view looking generally from the bottom and the back of a modified palette and easel assembly, identified in general by the reference numeral 54.

The vertical extensible hook 50 extends upward with respect to the modified easel 52 through a tube 53. The tube 53 is attached to a modified central cross member 55. A modified thumbscrew 57 is threaded through the tube 53 and, when either tightened or loosened, the modified thumbscrew 57 either allows the vertical extensible hook 50 to be extended or retracted as desired or secured in position.

The vertical extensible hook 50 holds the artist panel by securing the top center area of the artist panel. The bottom of the artist panel rests atop a pair of pivoting bottom supports 56. Of course the panel support shelf 30 of FIG. 1 could be used in place of the pair of pivoting bottom supports 56.

The pivoting bottom supports 56 each pivot about an axis 58 disposed at a first end thereof of each support 56 where the support is attached to a modified rear panel support member 60. The advantage of the pivoting bottom supports 56 is that they can accommodate and securely hold larger and thicker types of panels. To hold a thicker panel each of the pivoting bottom supports 56 is simply rotated forward to a greater extent thereby providing a deeper area to place a thicker panel on.

Also, the spacing apart of the pivoting bottom supports 56 provides a wider support base than does that of the panel support shelf 30 of FIG. 1 which is useful to secure a larger sized panel in position on the modified easel 52.

Either the pair of extensible hooks 44 of FIG. 1 or the vertical extensible hook 50 of FIG. 3 each provide a method to secure the artist panel to the easel 12 (or to the modified easel 52) that is adjustable and therefore can secure various sizes of panels thereto. They also, by their small profiles, provide a method of securing the panel to the easel 12 (or to the modified easel 52) that lessens the amount of paint that can be squeezed off of a brush stroke by an artist.

Referring again primarily to FIG. 1, FIG. 2, and FIG. 4 a supporting extensible member 62 is preferably formed of a material stock such as aluminum for lightness and has a right angle cross section so that a corresponding surface thereof bears against both the base plate 20 and one of the pair of side members 18.

It is shown in a first or closed position in FIG. 2. In the first position, the supporting extensible member 62 is retracted in toward the palette 14 and the easel 12 is pivoted into a closed position adjacent to and in parallel alignment with respect to the palette 14. In this position the assembly 10 is portable for use where desired, or it may be placed inside of an artist box (not shown) that is designed to accept it therein.

The supporting extensible member 62 is shown in a second or extended position in FIG. 1. The second position is for use of the assembly 10. A support screw 64 passes through a washer 66 and through a side slot 68 that is provided in the supporting extensible member 62 and is fastened to one of the pair of side members 18.

The support screw 64 is tightened to a predetermined tension that allows the supporting extensible member 62 to be either extended or retracted by pushing or pulling upon it as desired. The support screw 64, when set to a proper tension, does not have to be loosened or tightened during use. When set to the proper tension, it maintains the supporting extensible member 62 in a position of cooperation that is substantially adjacent to one of the pair of side members 18 and also to the base plate 20 in either the first or the second positions, and of course intermediate these positions.

The side slot 68 in cooperation with the support screw 64 determines the maximum range of extension and retraction of the supporting extensible member 62. The support screw 64 also secures the supporting extensible member 62 in a position of cooperation that is adjacent to one of the pair of side members 18.

Referring momentarily primarily to FIG. 2 and to FIG. 4, a bottom slot 65 is also provided in the supporting extensible member 62 and a bottom thumbscrew 67 passes through the bottom slot 65 and is threaded into one of the pair of side members 18 at a location that is generally toward the rear of one of the pair of side members 18. Accordingly, the bottom thumbscrew 67 is loosened and the supporting extensible member 62 is extended or retracted as desired into either the first or the second positions. The bottom thumbscrew 67 is then tightened to adequately secure the supporting extensible member 62 in the desired position.

Disposed at an end of the supporting extensible member 62 that is generally opposite that of the side slot 68 is a threaded hole 69 (FIG. 4) that can accommodate a first support thumbscrew 70. The first support thumbscrew 70 passes through a second slot 72 extending substantially the length of a side brace member 74.

A second support thumbscrew 76 also passes through the second slot and is fastened to one of the panel side members 34. When the supporting extensible member 62 is extended away from the palette 14 into the second position (FIG. 1) and the first support thumbscrew 70, the second support thumbscrew 76, and the support screw 64 are all tightened a triangle, identified in general by the reference numeral 78, is formed behind the easel 12 and the palette 14 that is able (by the structural rigidity associated with all mechanically formed triangles) to secure the easel 12 in any desired orientation with respect to the palette 14.

The triangle 78 is formed of that portion of the supporting extensible member 62 that extends to the rear of the palette 14, of the side brace member 74, and of that portion of one of the panel side members 34 disposed between the palette 14 and the side brace member 74.

As the easel 12 is rotated either further back or forward with respect to the palette 14, a correspondingly either lesser or greater amount of the side brace member 74 is used to form the triangle 78. Therefore by varying the size of the triangle 78 that is formed a method to vary the angle of the easel 12 with respect to the palette 14 is provided wherein the supporting structure that is used to secure them in position is disposed to the rear of the palette 14 and to the rear of the easel 12 where they can not interfere with the brush strokes of an artist. Therefore they can not accumulate any paint (not shown) off of an artist brush (not shown) and therefore an assembly 10 is provided that does not accumulate undesired paint during use.

Referring now primarily to FIG. 3, the tripod mount 24 is also shown as identical to that shown in FIG. 1 and is attached so that it is mounted flush with a bottom surface of a planar base 80 of a modified palette 82 of the modified palette and easel assembly 54.

A pivot tube 84 is pivotally attached to the planar base 80 by a screw (not shown). The screw passes though a first pivot end 86 of the pivot tube 84 and is attached to the planar base 80. The pivot tube 84 is maintained adjacent with respect to the planar base 80 by the screw and is able to pivot about the first pivot end 86 thereof so that in a first pivot position (shown in dashed lines), the pivot tube 84 is entirely contained under and adjacent to the planar base 80.

In a second pivot position (shown in solid lines), the pivot tube 84 extends out and away from the rear of the planar base 80 and also behind the modified easel 52. The location of the second pivot position is defined by the pivot tube 84 as it enters into a bracket 88 having a substantially U-shaped side opening 90 thereof. A pivot arrow 91 is shown in the drawing figure only for purposes of clarity to indicate the range of motion that is possible for the pivot tube 84.

The screw that is disposed at the first pivot end 86 is able to maintain the pivot tube 84 in a position that is adjacent to the planar base 80 providing no substantial force is applied to a second pivot end 92 of the pivot tube 84 that is disposed at the opposite end thereof with respect to the first pivot end 86.

The bracket 88 is attached to the rear of the modified palette 82 by a pair of screws 94. The modified palette 82 is pivotally attached to the modified easel 52 by a pair of modified hinges 96 that are disposed on opposite sides thereof.

When the pivot tube 84 is in the second pivot position, the U-shaped side opening 90 of the bracket 88 provides both a positive stop which properly orients the pivot tube 84 in the second pivot position, and also a method of maintaining the pivot tube adjacent to the planar base 80 even when a substantial force is applied to the second pivot end 92 of the pivot tube 84 which would otherwise tend to urge the pivot tube 84 away from the planar base 80.

Attached to second pivot end 92 is a modified center brace 98 that is constructed similar to the side brace member 74 of the assembly 10. A pair of thumbscrews 100 fasten the modified center brace 98 to both the second pivot end 92 of the pivot tube 84 and to modified central cross member 55. An access hole 102 is provided through the center of the modified easel 52 and is useful for tightening or for loosening one of the pair of thumbscrews 100 that secures the modified center brace 98 to the modified central cross member 55.

Accordingly as the pivot tube 84, the modified center brace 98, and a portion of the modified easel 52 similar provide a method of supporting and maintaining the modified easel 52 is a desired position with respect to the modified palette 82 that is disposed to the rear of both the modified easel 52 and the modified palette 82 and therefore does not interfere with the brush strokes of an artist.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A palette and easel assembly, comprising:

(a) an easel;

(b) a palette, said palette pivotally attached about an axis to said easel;

(c) means for securing said easel with respect to said palette, said means for securing having a first position and a second position, wherein said means for securing is not substantially extended to a rear of said palette and to a rear of said easel in said first position and wherein said means for securing is substantially extended to the rear of said palette and to the rear of said easel in said second position, said means for securing having an extensible member attached to said palette, said extensible member being adaptable to said first position and to said second position and having a side brace member, said side brace member being attached at one end thereof to said extensible member at an end of said extensible member that is disposed furthest from said palette when said extensible member is disposed in said second position, and said side brace member being attached at a remaining end of said side brace member to said easel.

2. The palette and easel assembly of claim 1 wherein said extensible member includes at least one longitudinal slot.

3. The palette and easel assembly of claim 1 wherein said side brace member includes a longitudinal slot, said longitudinal slot providing a means for securing said easel at a desired angle with respect to said palette.

4. The palette and easel assembly of claim 1 including a pair of thumbscrews, said pair of thumbscrews for detachably attaching said side brace member to said easel pivotally about one of said pair of thumbscrews and for detachably attaching said side brace member to said end of said extensible member that is disposed furthest from said palette pivotally about the remainder of said pair of thumbscrews.

5. The palette and easel assembly of claim 1 including a panel support shelf attached to said easel, said panel support shelf adapted for supporting an artist panel.

6. The palette and easel assembly of claim 1 including a pair of bottom supports attached to said easel, said pair of bottom supports adapted for supporting an artist panel.

7. The palette and easel assembly of claim 6 wherein said pair of bottom supports are each adapted to pivot with respect to said easel.

8. The palette and easel assembly of claim 1 including extensible means for securing an artist panel to said easel, said extensible means extensibly attached to said easel.

9. The palette and easel assembly of claim 8 wherein said extensible means for securing includes a pair of extensible hooks disposed within a channel, said pair of hooks adapted to secure a first and a second side of said artist panel.

10. The palette and easel assembly of claim 9 including means for securing said pair of extensible hooks in a predetermined position.

11. The palette and easel assembly of claim 8 wherein said extensible means for securing includes a vertically extensible hook adapted to secure a top of said artist panel to said easel.

12. The palette and easel assembly of claim 1 wherein said easel is adapted to pivot about said palette into a position wherein said easel is disposed adjacent to and in parallel planar alignment with respect to said palette.

13. The palette and easel assembly of claim 12 wherein said palette and said easel form a box.

14. A palette and easel assembly, comprising:

(a) an easel;

(b) a palette, said palette pivotally attached about an axis to said easel;

(c) means for securing said easel with respect to said palette, said means for securing having a first position and a second position, wherein said means for securing is not substantially extended to a rear of said palette and to a rear of said easel in said first position and wherein said means for securing is substantially extended to the rear of said palette and to the rear of said easel in said second position, said means for securing including a member having a first end and a second end that is disposed opposite to said first end, said member pivotally attached at said first end to said palette, said member being adaptable to pivot between said first position and said second position wherein said member is in parallel alignment with respect to a plane of said palette in said first position and in said second position, and including a center brace that is detachably attached at a first brace end to said second end of said member when said member is disposed in said second position, and is detachably attached at a second brace end to said easel when said member is disposed in said second position, said second brace end being disposed opposite to said first brace end.

15. The palette and easel assembly of claim 14 wherein said center brace includes a longitudinal slot, said longitudinal slot providing a means of maintaining said easel at a desired angle with respect to said palette.

16. The palette and easel assembly of claim 14 wherein said easel includes a hole therein, said hole adapted to facilitate attachment of said second brace end to said easel.

17. The palette and easel assembly of claim 14 including a bracket attached to said palette, said bracket including means adapted for cooperating with said member in said second position.

18. The palette and easel assembly of claim 17 wherein said means adapted for cooperating includes means for maintaining said member in said parallel position when said member is disposed in said second position.

19. The palette and easel assembly of claim 18 wherein said means for maintaining includes a substantially U-shaped slot formed in said bracket.

* * * * *